US011111752B2

(12) United States Patent
Fuhst et al.

(10) Patent No.: US 11,111,752 B2
(45) Date of Patent: Sep. 7, 2021

(54) WATER AND GAS BARRIER FOR HYDRAULIC SYSTEMS

(71) Applicants: Karsten Fuhst, Glesen (DE); Volker Peters, Wienhausen (DE); Christian Preiser, Wienhausen (DE); Nils Schneider, Ehlershausen (DE); Ingo Roders, Seelze (DE); Natalja Wendt, Seelze (DE); Sebastian Jung, Isernhagen (DE); Thomas Kruspe, Wietzendorf (DE)

(72) Inventors: Karsten Fuhst, Glesen (DE); Volker Peters, Wienhausen (DE); Christian Preiser, Wienhausen (DE); Nils Schneider, Ehlershausen (DE); Ingo Roders, Seelze (DE); Natalja Wendt, Seelze (DE); Sebastian Jung, Isernhagen (DE); Thomas Kruspe, Wietzendorf (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 226 days.

(21) Appl. No.: 16/216,399

(22) Filed: Dec. 11, 2018

(65) Prior Publication Data

US 2020/0182009 A1 Jun. 11, 2020

(51) Int. Cl.
*E21B 33/12* (2006.01)
*E21B 23/04* (2006.01)

(52) U.S. Cl.
CPC ..... *E21B 33/1208* (2013.01); *E21B 23/04* (2013.01); *E21B 2200/01* (2020.05)

(58) Field of Classification Search
CPC ..... E21B 33/12–12955; F16J 15/022; F16J 15/0806; F16J 15/0825; F16J 15/104; F16J 15/12; F16J 15/122; F16J 15/128; F16J 2015/0856
See application file for complete search history.

(56) References Cited

U.S. PATENT DOCUMENTS 3,579,412 A * 5/1971 Paine ..... C23C 6/00 442/7
3,837,947 A * 9/1974 Malone ..... E21B 33/1277 156/69
4,601,475 A * 7/1986 Nicholson ..... F16J 15/3212 277/560
6,125,938 A 10/2000 Garcia-Soule et al.
6,296,054 B1 * 10/2001 Kunz ..... E21B 33/1277 166/187

(Continued)

OTHER PUBLICATIONS

International Search Report and Written Opinion for International Application No. PCT/US2019/063339; International Filing Date Nov. 26, 2019; Report dated Mar. 17, 2020 (pp. 1-6).

*Primary Examiner* — Steven A MacDonald
(74) *Attorney, Agent, or Firm* — Cantor Colburn LLP

(57) ABSTRACT

A downhole tool including a body having a hydraulic fluid chamber, and a flexible multi-layer barrier impermeable to gas and water mounted at the body separating the hydraulic fluid chamber from fluids external to the body. The flexible multi-layer barrier including a first elastomeric layer, a second elastomeric layer, and a gas impermeable layer arranged between the first elastomeric layer and the second elastomeric layer, the gas impermeable layer being formed from a metal layer.

19 Claims, 5 Drawing Sheets

(56) References Cited

U.S. PATENT DOCUMENTS

| | | | | |
|---|---|---|---|---|
| 6,732,797 | B1 | 5/2004 | Watters et al. | |
| 2003/0159829 | A1 | 8/2003 | Fripp et al. | |
| 2004/0055758 | A1* | 3/2004 | Brezinski | E21B 43/106 166/384 |
| 2013/0126184 | A1 | 5/2013 | Gerrard et al. | |
| 2016/0024873 | A1 | 1/2016 | Brandsdal | |
| 2019/0100977 | A1* | 4/2019 | Corre | E21B 49/08 |

* cited by examiner

WATER AND GAS BARRIER FOR HYDRAULIC SYSTEMS

BACKGROUND

In the resource exploration and recovery industry, hydraulic actuators and hydraulically compensated sensors are used in a wide array of applications. Hydraulic pumps, hydraulic actuators, hydraulically compensated sensors, and other systems may rely on principles of hydraulic pressure or pressurized liquid. Typically, the pressurized liquid takes the form of hydraulic oil. The hydraulic oil possesses various properties that may degrade if exposed to contaminants such as gas and water. Both gas and water are present in subterranean formations where hydraulic actuators are in use.

Currently, hydraulic oil or fluid is shielded from contaminants by an elastomeric membrane or a piston that includes a seal. The elastomeric membrane or piston separate the hydraulic fluid from wellbore fluid including gas and water. Subterranean conditions include temperatures and pressures that act upon the elastomeric membrane or piston seals. Thus, over time, the wellbore fluids may permeate the elastomeric membrane or seals and contaminate the hydraulic fluid. Water in the hydraulic fluid may cause corrosion of internal components. Invading gases may lead to a need for increased maintenance cycles. Accordingly, the industry would be receptive of an improved water and gas barrier for hydraulic systems.

SUMMARY

Disclosed is a downhole tool including a body having a hydraulic fluid chamber, and a flexible multi-layer barrier impermeable to gas and water mounted at the body separating the hydraulic fluid chamber from fluids external to the body. The flexible multi-layer barrier including a first elastomeric layer, a second elastomeric layer, and a gas impermeable layer arranged between the first elastomeric layer and the second elastomeric layer, the gas impermeable layer being formed from a metal layer.

Also disclosed is a resource exploration and recovery system including a first system, a second system fluidically connected to the first system by one or more tubulars, and a downhole tool carried by the one or more tubulars. The downhole tool includes a body including a hydraulic chamber, and a flexible multi-layer barrier impermeable to gas and water mounted at the body separating the hydraulic chamber from fluids external to the body. The flexible multi-layer barrier includes a first elastomeric layer, a second elastomeric layer, and a gas impermeable layer arranged between the first elastomeric layer and the second elastomeric layer, the gas impermeable layer being formed from a metal layer.

Further disclosed is a subsurface hydraulic system including a flexible multi-layer barrier separating a hydraulic fluid chamber from fluids external to the subsurface hydraulic system. The flexible multi-layer barrier is impermeable to gas and water and includes a single elastomeric layer bonded to a gas impermeable layer formed from a ductile metal.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
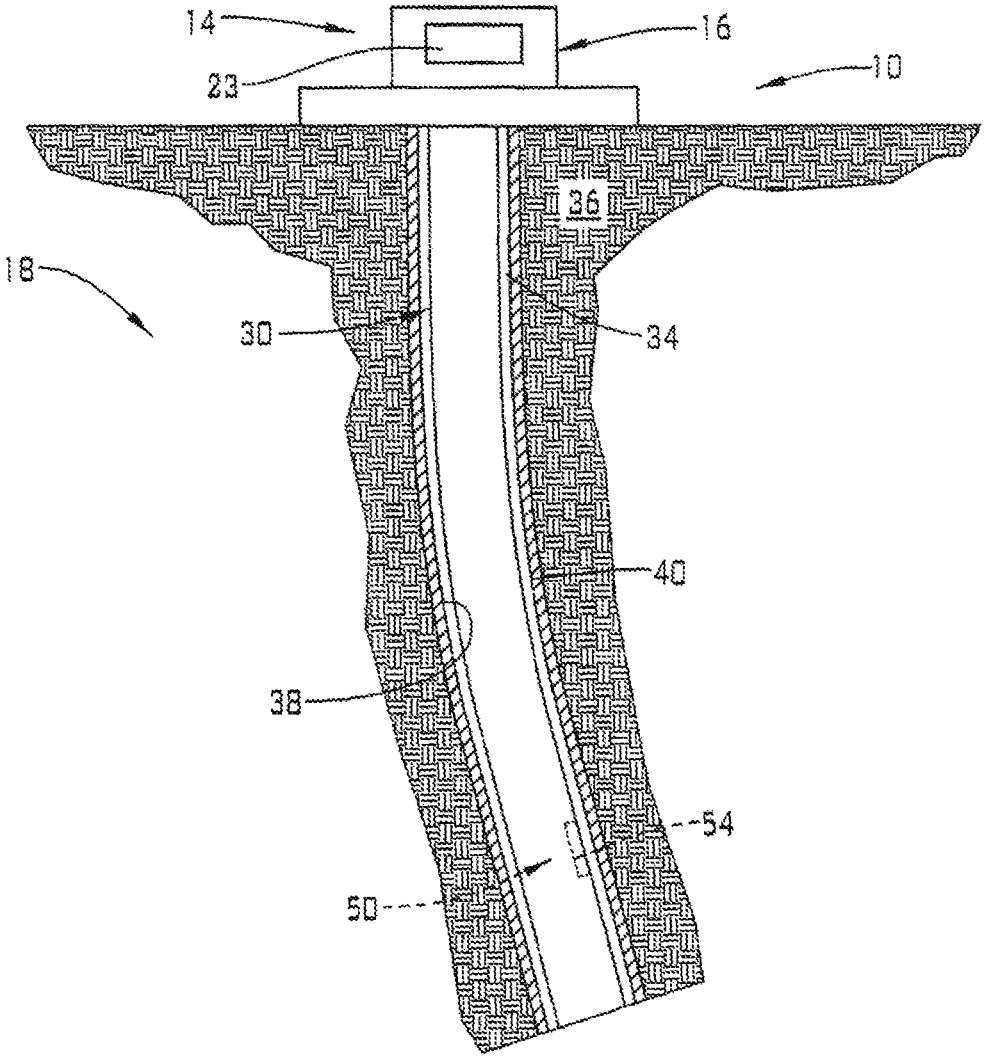
FIG. 1 depicts a resource exploration and recovery system including a hydraulic system having a water and gas barrier, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Tubular string 30 may be formed by a series of interconnected discrete tubulars or by a single tubular that could take the form of coiled tubing or a wireline. Wellbore 34 includes an annular wall 38 which may be defined by a surface of formation 36, or, in the embodiment shown, by a casing tubular 40. It should be understood that wellbore 34 may also include an open hole configuration.

Figure 2:
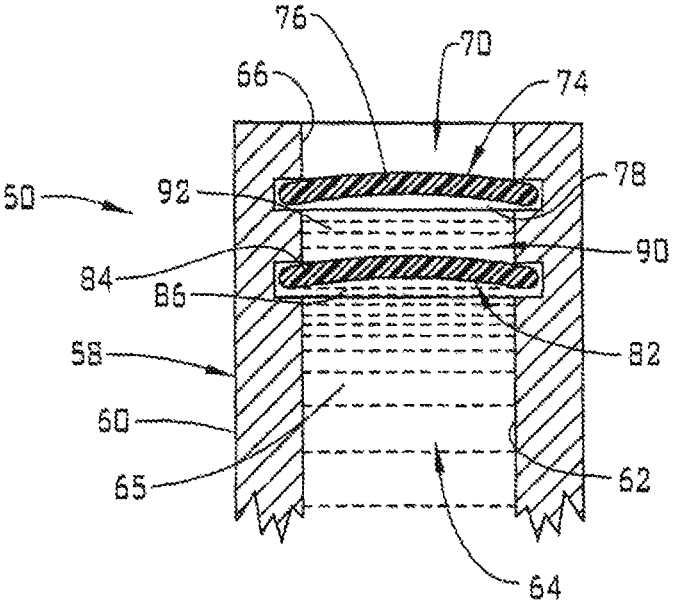
FIG. 2 depicts the hydraulic system of FIG. 1 with a water and gas barrier, in accordance with an aspect of an exemplary embodiment.

In an embodiment, tubular string 30 supports a hydraulic system 50 that may take the form of a hydraulic actuator 54. Of course, it should be understood, that hydraulic system 50 may take on a variety of forms. With reference to FIG. 2, hydraulic system 50 includes a body 58 having outer surface 60 and an inner surface 62 that defines a hydraulic chamber 64 that houses a hydraulic fluid 65. Body 58 includes an opening 66 that is exposed to wellbore fluids including at least one of water and gas. The phase "at least one of water and gas" should be understood to describe the two substances in the disjunctive, not the conjunctive.

In an embodiment, a flexible multi-layer barrier 70 is arranged at opening 66 to isolate hydraulic fluid 65 from the wellbore fluids. Flexible multi-layer barrier 70 includes a first elastomeric layer 74 defined by a first membrane 76. First elastomeric layer 74 is retained in a first recess 78 formed in inner surface 62. A second elastomeric layer 82 is spaced from first elastomeric layer 74 by a void (not separately labeled). Second elastomeric layer 82 takes the form of a second membrane 84 that is retained in a second recess 86 formed in inner surface 62.

At this point, it should be understood that the term "elastomeric layer" describes a member formed from an elastomer and may take the form of a flexible membrane, a rigid membrane or the like. Elastomeric layer may be formed from a variety of materials including polymers with viscoelasticity (e.g., polymers including both viscosity and elasticity), polytetrafluoroethylene (PTFE) and the like.

In an embodiment, a gas impermeable layer 90 is disposed between first elastomeric layer 74 and second elastomeric layer 82. Gas impermeable layer 90 may take the form of a barrier fluid 92 that is arranged in the void between first elastomeric layer 74 and second elastomeric layer 82.

In one embodiment, barrier fluid 92 may include perfluoropolyether (PFPE) oil, grease or a metal having a melting point below about 30° C. such as mercury, gallium or gallium based alloys e.g., Galinstan. The melting temperatures of such metals are: Gallium 29.8° C.; Galinstan minus 19.5° C.; Mercury minus 38.8° C. Barrier fluid 92 will not absorb wellbore fluids including water and/or gas. Further barrier fluid 92 will not transport wellbore fluids such as water and/or gas between first elastomeric layer 74 and second elastomeric layer 82.

Figure 3:
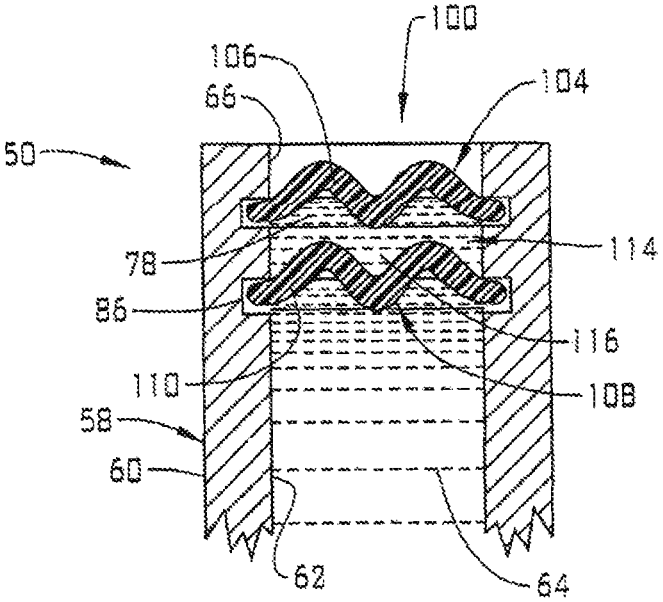
FIG. 3 depicts the hydraulic system of FIG. 1 with a water and gas barrier, in accordance with another aspect of an exemplary embodiment.

Reference will now follow to FIG. 3, wherein like reference numbers represent corresponding parts in the respective views in describing a flexible multi-layer barrier 100 in accordance with another exemplary aspect. Flexible multi-layer barrier 100 includes a first elastomeric layer 104 defined by a first bellows 106 secured in first recess 78. A second elastomeric layer 108 is spaced from first elastomeric layer 104 by a void (not separately labeled). Second elastomeric layer 108 takes the form of a second bellows 110 supported in second recess 86.

A gas impermeable layer 114 is arranged between first elastomeric layer 104 and second elastomeric layer 108. Gas impermeable layer 114 takes the form of a barrier fluid 116 arranged in the void defined between first elastomeric layer 104 and second elastomeric layer 108. In a manner similar to that detailed herein, barrier fluid 116 may include PFPE oil, grease or a metal having a melting point below about 30° C. such as mercury or gallium based alloys e.g., Galinstan. Barrier fluid 104 will not absorb wellbore fluids including water and/or gas. Further barrier fluid 104 will not transport wellbore fluids such as water and/or gas between first elastomeric layer 104 and second elastomeric layer 108.

Figure 4:
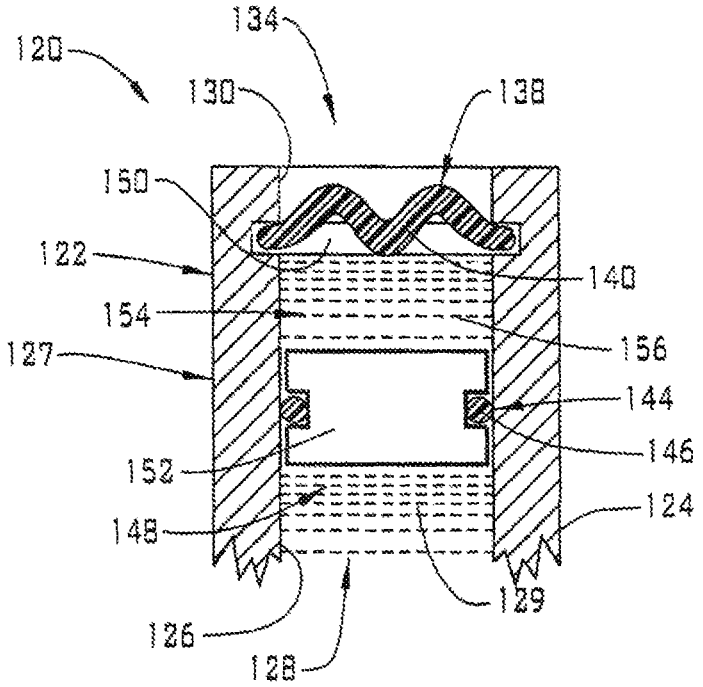
FIG. 4 depicts the hydraulic system of FIG. 1 with a water and gas barrier, in accordance with yet another aspect of an exemplary embodiment.

Reference will now follow to FIG. 4 in describing a hydraulic system 120 in accordance with another aspect of an exemplary embodiment. Hydraulic system 120 includes a body 122 having an outer surface 124 and an inner surface 126 defining a hydraulic chamber 128. An amount of hydraulic fluid 129 is arranged in hydraulic chamber 128. An opening 130 is defined by body 127 and is exposed to wellbore fluids. A flexible multi-layer barrier 134 is arranged at opening 130 to fluidically isolate hydraulic fluid 129 from wellbore fluids.

In an embodiment, flexible multi-layer barrier 134 includes a first elastomeric layer 138 that takes the form of a first bellows 140 and a second elastomeric layer 144 that takes the form of a seal 146 that extends about a piston 148. Bellows 140 resides in a recess 150 formed in inner surface 126. Seal 146 may take the form of an O-ring (not separately labeled) that resides in a recess 152 extending about piston 148. A gas impermeable layer 154 is arranged in a void (not separately labeled) defined between first elastomeric layer 138 and second elastomeric layer 144. Gas impermeable layer 154, in an embodiment, takes the form of a barrier fluid 156.

In a manner similar to that detailed herein, barrier fluid 156 may include PFPE oil, grease or a metal having a melting point below about 30° C. such as mercury or gallium based alloys e.g., Galinstan. Barrier fluid 156 will not absorb wellbore fluids including water and/or gas. Further barrier fluid 156 will not transport wellbore fluids such as water and/or gas between first elastomeric layer 138 and second elastomeric layer 144.

Figure 5:
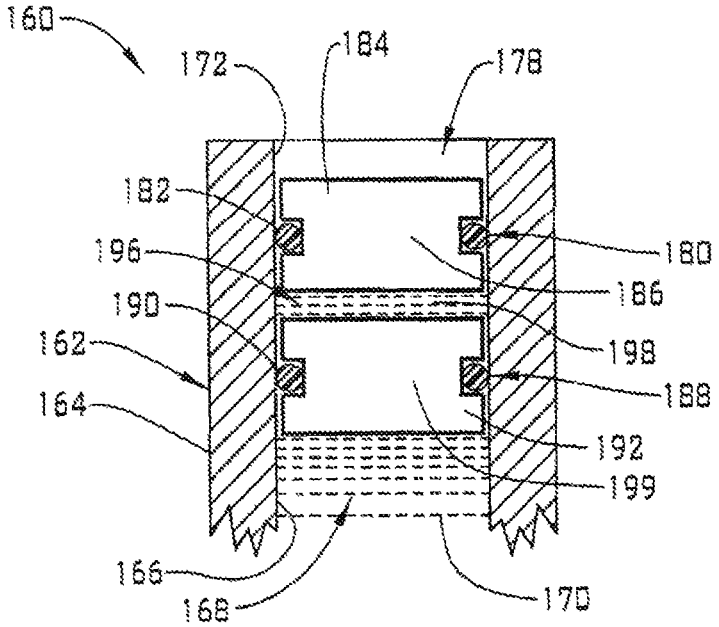
FIG. 5 depicts the hydraulic system of FIG. 1 with a water and gas barrier, in accordance with still yet another aspect of an exemplary embodiment.

Reference will now follow to FIG. 5 in describing a hydraulic system 160 in accordance with another exemplary embodiment. Hydraulic system 160 includes a body 162 having an outer surface 164 and an inner surface 166 defining a hydraulic chamber 168. An amount of hydraulic fluid 170 is arranged in hydraulic chamber 168. An opening 172 is defined by body 162 and is exposed to wellbore fluids. A flexible multi-layer barrier 178 is arranged at opening 172 to fluidically isolate hydraulic fluid 170 from wellbore fluids.

In an embodiment, flexible multi-layer barrier 178 includes a first elastomeric layer 180 that takes the form of a first seal 182 that extends about a first piston 184. First seal 182 may take the form of a first O-ring (not separately labeled) that resides in a first groove 186 extending about first piston 184. A second elastomeric layer 188 that takes the form of a second seal 146 is spaced from first elastomeric layer 180. Second seal 190 extends about a second piston 192. Second seal 190 may take the form of an O-ring (not separately labeled) that resides in a second groove 194 extending about second piston 192. A gas impermeable layer 196 is arranged in a void (also not separately labeled) defined between first elastomeric layer 180 and second elastomeric layer 188. Gas impermeable layer 196 in an embodiment, takes the form of a barrier fluid 198.

In a manner similar to that detailed herein, barrier fluid 198 may include PFPE oil, grease or a metal having a melting point below about 30° C. such as mercury or gallium based alloys e.g., Galinstan, Barrier fluid 198 will not absorb wellbore fluids including water and/or gas. Further barrier fluid 198 will not transport wellbore fluids such as water and/or gas between first elastomeric layer 180 and second elastomeric layer 188.

Figure 6:
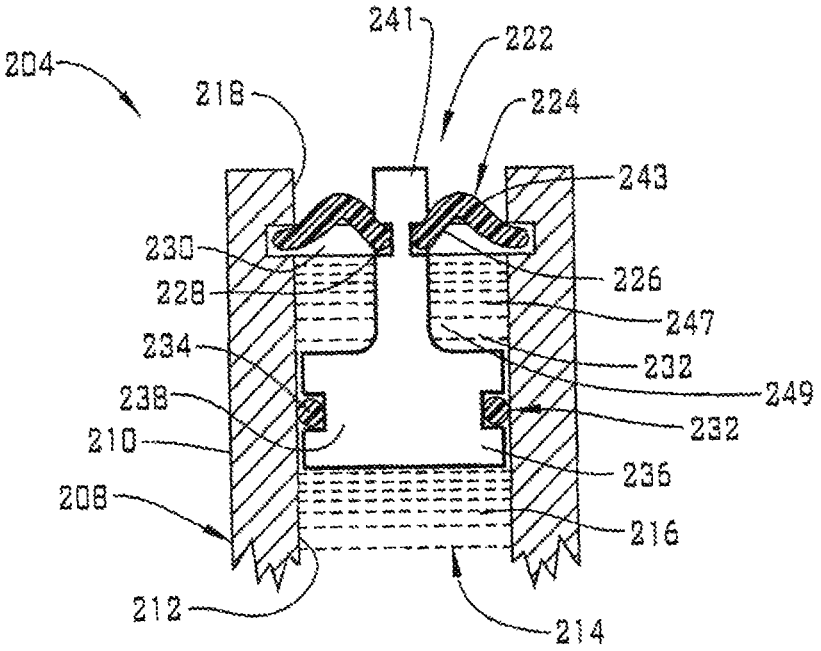
FIG. 6 depicts the hydraulic system of FIG. 1 with a water and gas barrier, in accordance with yet still another aspect of an exemplary embodiment.

Reference will now follow to FIG. 6 in describing a hydraulic system 204 in accordance with another exemplary embodiment. Hydraulic system 204 includes a body 208 having an outer surface 210 and an inner surface 212 defining a hydraulic chamber 214. An amount of hydraulic fluid 216 is arranged in hydraulic chamber 214. An opening 218 is defined by body 208 and is exposed to wellbore fluids. A flexible multi-layer barrier 222 is arranged at opening 218 to fluidically isolate hydraulic fluid 216 from wellbore fluids.

In an embodiment, flexible multi-layer barrier 222 includes a first elastomeric layer 224 that takes the form of a first membrane 226 having a central opening 228. First membrane 226 resides in a recess 230 formed in inner surface 212. A second elastomeric layer 232, that takes the form of a seal 234, is spaced from first elastomeric layer 224. Seal 234 extends about a piston 236. Seal 234 may take the form of an O-ring (not separately labeled) that resides in a first groove 238 extending about piston 236. Piston 236 includes an end portion 241 having a reduced diameter. End portion 241 includes a second groove 243. End portion 241 extends through central openings 228 with first elastomeric layer 224 nesting in second groove 243.

A gas impermeable layer 247 is arranged in a void (not separately labeled) defined between first elastomeric layer 224 and second elastomeric layer 232. Gas impermeable layer 247 in an embodiment, takes the form of a barrier fluid 249. In a manner similar to that detailed herein, barrier fluid 249 may include PFPE oil, grease or a metal having a melting point below about 30° C. such as mercury or gallium based alloys e.g., Galinstan. Barrier fluid 249 will not absorb wellbore fluids including water and/or gas. Further barrier fluid 249 will not transport wellbore fluids such as water and/or gas between first elastomeric layer 224 and second elastomeric layer 232.

Figure 7:
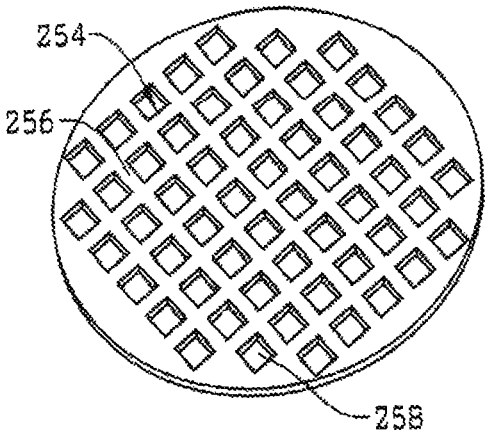
FIG. 7 depicts cavities formed in an elastomeric layer of the water and gas barrier, in accordance with an exemplary aspect.

FIG. 7 depicts an elastomeric layer 254 in accordance with an exemplary aspect. Elastomeric layer 254 may be employed as one, another, or both of the first and second elastomeric layers described herein. Elastomeric layer 254 includes a surface 256 having a plurality of cavities 258. Cavities 258 may retain an amount of barrier fluid thereby increasing an amount of barrier fluid that may reside in a void (not separately labeled) defined between first and second elastomeric layers. Further, cavities 258 may reduce contact surface area between the two elastomeric layers and thereby reduce any pathways for transportation of water/gas from one elastomeric layer to the other.

Figure 8:
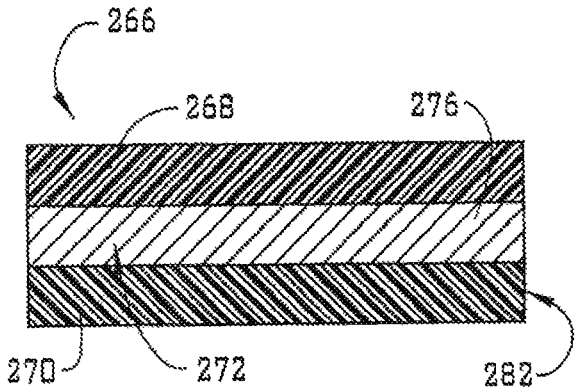
FIG. 8 depicts a water and gas barrier formed as a laminated membrane, in accordance with an aspect of an exemplary embodiment.

Reference will follow to FIG. 8 in describing a flexible multi-layer barrier 266 in accordance with another aspect of an exemplary embodiment. Flexible multi-layer barrier 266 includes a first elastomeric layer 268 a second elastomeric layer 270 and a gas impermeable layer 272 arranged therebetween. In an embodiment, gas impermeable layer 272 takes the form of a metal layer 276 formed from a ductile metal material. The term "ductile metal material" should be understood to describe a metal material having a recrystallization temperature that is below a lowest application temperature such as, for example, lead which may recrystallize at room temperature. The selected recrystallization temperature leads to a material that is ductile under operation temperature. Repeated plastic deformation of such metal will not lead to fatigue or crack formation provided there is sufficient time for recrystallization. The application of such ductile metal layer can contribute to an overall flexibility of flexible multi-layer barrier 266. In the embedment shown, first elastomeric layer 268, gas impermeable layer 272, and second elastomeric layer 270 are joined so as to define a unitary body 282.

Figure 9:
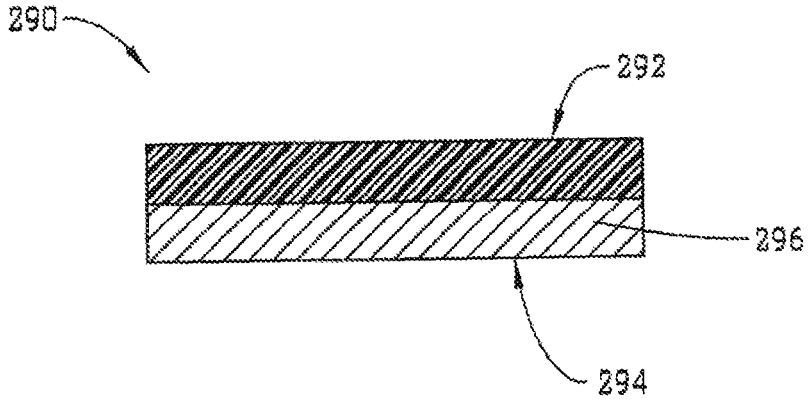
FIG. 9 depicts a water and gas barrier formed as a laminated membrane, in accordance with another aspect of an exemplary embodiment.

Reference will follow to FIG. 9 in describing a flexible multi-layer barrier 290 in accordance with another aspect of an exemplary embodiment. Flexible multi-layer barrier 290 includes a single elastomeric layer 292 and a gas impermeable layer 294 bonded against each other. In an embodiment, gas impermeable layer 294 takes the form of a metal layer 296 formed from a metal material having a selected recrystallization temperature. In an embodiment, the selected recrystallization temperature is below the lowest application temperature such as, for example, lead which may recrystallize at room temperature. The selected recrystallization temperature leads to a material that is ductile. Bonding of single elastomeric layer 292 and gas impermeable layer 294 could be achieved by gluing or vulcanizing.

The exemplary embodiments describe a flexible barrier that ensures that wellbore fluids such as water and gases do not invade into spaced occupied by hydraulic fluid. The flexible barrier reduces the need to maintain hydraulic systems, prolongs an overall service life of the hydraulic systems that promote both time and cost savings for wellbore operations.

Set forth below are some embodiments of the foregoing disclosure:

Embodiment 1: A downhole tool comprising: a body including a hydraulic fluid chamber; and a flexible multi-layer barrier impermeable to gas and water mounted at the body separating the hydraulic fluid chamber from fluids external to the body, the flexible multi-layer barrier comprising: a first elastomeric layer; a second elastomeric layer; and a gas impermeable layer arranged between the first elastomeric layer and the second elastomeric layer, the gas impermeable layer being formed from a metal layer.

Embodiment 2: The downhole tool according to any prior embodiment, wherein the metal layer comprises a metal having a melting point less than about 30° C.

Embodiment 3: The downhole tool according to any prior embodiment, wherein the first elastomeric layer is spaced from the second elastomeric layer by a void, the void being filled with a barrier fluid defining the gas impermeable layer.

Embodiment 4: The downhole tool according to any prior embodiment, further comprising: a first piston supporting the first elastomeric layer arranged in the body, and a second piston supporting the second elastomeric layer arranged in the body, wherein the barrier fluid is arranged between the first and second pistons.

Embodiment 5: The downhole tool according to any prior embodiment, wherein the first elastomeric layer defines a first seal extending about the first piston and the second elastomeric layer defines a second seal extending about the second piston.

Embodiment 6: The downhole tool according to any prior embodiment, wherein the first elastomeric layer defines a membrane extending across the body.

Embodiment 7: The downhole tool according to any prior embodiment, further comprising: a piston arranged in the body supporting the second elastomeric layer.

Embodiment 8: The downhole tool according to any prior embodiment, wherein the second elastomeric layer defines a seal extending about the piston.

Embodiment 9: The downhole tool according to any prior embodiment, wherein the first elastomeric layer includes a central opening, at least a portion of the piston extending through the central opening.

Embodiment 10: The downhole tool according to any prior embodiment, wherein the first elastomeric layer comprises a first membrane, and the second elastomeric layer comprises a second membrane, the first membrane including a first plurality of cavities, and the second membrane including a second plurality of cavities, the gas impermeable layer defining a barrier fluid arranged in at least one of the first plurality of cavities and the second plurality of cavities.

Embodiment 11: The downhole tool according to any prior embodiment, wherein the flexible multi-layer barrier comprises a laminate material with the first elastomeric layer being bonded to the second elastomeric layer through the metal layer, the metal layer comprising a ductile metal.

Embodiment 12: A resource exploration and recovery system comprising: a first system; a second system fluidically connected to the first system by one or more tubulars;

and a downhole tool carried by the one or more tubulars, the downhole tool comprising: a body including a hydraulic chamber; and a flexible multi-layer barrier impermeable to gas and water mounted at the body separating the hydraulic chamber from fluids external to the body, the flexible multi-layer barrier comprising: a first elastomeric layer; a second elastomeric layer; and a gas impermeable layer arranged between the first elastomeric layer and the second elastomeric layer, the gas impermeable layer being formed from a metal layer.

Embodiment 13: The resource exploration and recovery system according to any prior embodiment, wherein the metal layer includes a metal having melting point below 30° C.

Embodiment 14: The resource exploration and recovery system according to any prior embodiment, wherein the first elastomeric layer is spaced from the second elastomeric layer by a void, the void being filled with a barrier fluid defining the gas impermeable layer.

Embodiment 15: The resource exploration and recovery system according to any prior embodiment, further comprising: a first piston supporting the first elastomeric layer arranged in the body, and a second piston supporting the second elastomeric layer arranged in the body, wherein the barrier fluid is arranged between the first and second pistons.

Embodiment 16: The resource exploration and recovery system according to any prior embodiment, wherein the first elastomeric layer defines a membrane extending across the body.

Embodiment 17: The resource exploration and recovery system according to any prior embodiment, further comprising: a piston arranged in the body supporting the second elastomeric layer.

Embodiment 18: The resource exploration and recovery system according to any prior embodiment, wherein the first elastomeric layer includes a central opening, at least a portion of the piston extending through the central opening.

Embodiment 19: The resource exploration and recovery system according to any prior embodiment, wherein the first elastomeric layer comprises a first membrane, and the second elastomeric layer comprises a second membrane, the first membrane including a first plurality of cavities, and the second membrane including a second plurality of cavities, the metal layer defining a barrier fluid arranged in at least one of the first plurality of cavities and the second plurality of cavities.

Embodiment 20: A subsurface hydraulic system comprising: a flexible multi-layer barrier separating a hydraulic fluid chamber from fluids external to the subsurface hydraulic system, the flexible multi-layer barrier being impermeable to gas and water and including a single elastomeric layer bonded to a gas impermeable layer formed from a ductile metal.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a body including a hydraulic fluid chamber; and a flexible multi-layer barrier impermeable to gas and water mounted at the body separating the hydraulic fluid chamber from fluids external to the body, the flexible multi-layer barrier comprising:

a first elastomeric layer;

a second elastomeric layer; and a gas impermeable layer arranged between the first elastomeric layer and the second elastomeric layer, the gas impermeable layer being formed from a metal layer, wherein the metal layer comprises a metal having a melting point less than about 30° C.

2. The downhole tool according to claim 1, wherein the first elastomeric layer is spaced from the second elastomeric layer by a void, the void being filled with a barrier fluid defining the gas impermeable layer.

3. The downhole tool according to claim 2, further comprising: a first piston supporting the first elastomeric layer arranged in the body, and a second piston supporting the second elastomeric layer arranged in the body, wherein the barrier fluid is arranged between the first and second pistons.

4. The downhole tool according to claim 3, wherein the first elastomeric layer defines a first seal extending about the first piston and the second elastomeric layer defines a second seal extending about the second piston.

5. The downhole tool according to claim 2, wherein the first elastomeric layer defines a membrane extending across the body.

6. The downhole tool according to claim 5, further comprising: a piston arranged in the body supporting the second elastomeric layer.

7. The downhole tool according to claim 6, wherein the second elastomeric layer defines a seal extending about the piston.

8. The downhole tool according to claim 6, wherein the first elastomeric layer includes a central opening, at least a portion of the piston extending through the central opening.

9. The downhole tool according to claim 1, wherein the first elastomeric layer comprises a first membrane, and the second elastomeric layer comprises a second membrane, the first membrane including a first plurality of cavities, and the second membrane including a second plurality of cavities, the gas impermeable layer defining a barrier fluid arranged in at least one of the first plurality of cavities and the second plurality of cavities.

10. The downhole tool according to claim 1, wherein the flexible multi-layer barrier comprises a laminate material with the first elastomeric layer being bonded to the second elastomeric layer through the metal layer.

11. A resource exploration and recovery system comprising:

a first system;

a second system fluidically connected to the first system by one or more tubulars; and a downhole tool carried by the one or more tubulars, the downhole tool comprising:

a body including a hydraulic chamber; and a flexible multi-layer barrier impermeable to gas and water mounted at the body separating the hydraulic chamber from fluids external to the body, the flexible multi-layer barrier comprising:

a first elastomeric layer;

a second elastomeric layer; and a gas impermeable layer arranged between the first elastomeric layer and the second elastomeric layer, the gas impermeable layer being formed from a metal layer, wherein the metal layer comprises a metal having a melting point less than about 30° C.

12. The resource exploration and recovery system according to claim 11, wherein the first elastomeric layer is spaced from the second elastomeric layer by a void, the void being filled with a barrier fluid defining the gas impermeable layer.

13. The resource exploration and recovery system according to claim 12, further comprising: a first piston supporting the first elastomeric layer arranged in the body, and a second piston supporting the second elastomeric layer arranged in the body, wherein the barrier fluid is arranged between the first and second pistons.

14. The resource exploration and recovery system according to claim 12, wherein the first elastomeric layer defines a membrane extending across the body.

15. The resource exploration and recovery system according to claim 14, further comprising: a piston arranged in the body supporting the second elastomeric layer.

16. The resource exploration and recovery system according to claim 15, wherein the first elastomeric layer includes a central opening, at least a portion of the piston extending through the central opening.

17. The resource exploration and recovery system according to claim 11, wherein the first elastomeric layer comprises a first membrane, and the second elastomeric layer comprises a second membrane, the first membrane including a first plurality of cavities, and the second membrane including a second plurality of cavities, the metal layer defining a barrier fluid arranged in at least one of the first plurality of cavities and the second plurality of cavities.

18. A subsurface hydraulic system operable in a subterranean environment comprising:

a flexible multi-layer barrier separating a hydraulic fluid chamber from fluids external to the subsurface hydraulic system, the flexible multi-layer barrier being impermeable to gas and water and including a single elastomeric layer bonded to a gas impermeable layer formed from a metal having a recrystallization temperature that is below a lowest temperature of the subterranean environment.

19. A downhole tool, configured to operate in a subterranean environment comprising:

a body including an inner annular wall defining a hydraulic fluid chamber; and a flexible multi-layer barrier impermeable to gas and water mounted at the body separating the hydraulic fluid chamber from fluids external to the body, the flexible multi-layer barrier comprising:

a first elastomeric layer;

a second elastomeric layer; and a metal layer, wherein the metal layer comprises a metal having a recrystallization temperature that is below a lowest temperature of the subterranean environment.

* * * * *